US007107154B2

(12) United States Patent
Ward

(10) Patent No.: US 7,107,154 B2
(45) Date of Patent: Sep. 12, 2006

(54) WELLBORE EVALUATION SYSTEM AND METHOD

(75) Inventor: Simon J. Ward, Spring, TX (US)

(73) Assignee: Robbins & Myers Energy Systems L.P., Houston, TX (US)

( * ) Notice: Subject to any disclaimer, the term of this patent is extended or adjusted under 35 U.S.C. 154(b) by 0 days.

(21) Appl. No.: 10/853,592

(22) Filed: May 25, 2004

(65) Prior Publication Data

US 2005/0267686 A1 Dec. 1, 2005

(51) Int. Cl.
*G01V 1/40* (2006.01)
*E21B 25/16* (2006.01)

(52) U.S. Cl. ..... 702/6; 175/45

(58) Field of Classification Search ..... 702/6, 702/33, 34, 81, 84; 705/22, 28; 175/45, 175/46

See application file for complete search history.

(56) References Cited

U.S. PATENT DOCUMENTS

| | | | | |
|---|---|---|---|---|
| 2,555,853 | A | 6/1951 | Irwin | 324/242 |
| 2,855,564 | A | 10/1958 | Irwin et al. | 324/242 |
| 3,753,296 | A | 8/1973 | Van Steenwyk | 33/324 |
| 3,958,049 | A | 5/1976 | Payne | 427/327 |
| 4,492,115 | A | 1/1985 | Kahil et al. | 73/152.01 |
| 4,636,727 | A | 1/1987 | Kahil et al. | 324/227 |
| 4,715,442 | A | 12/1987 | Kahil et al. | 166/250.01 |
| 4,843,317 | A | 6/1989 | Dew | 324/221 |
| 4,987,684 | A | 1/1991 | Andreas et al. | 33/304 |
| 5,115,863 | A | 5/1992 | Olinger | 166/241.5 |
| 5,339,896 | A | 8/1994 | Hart et al. | 166/241.1 |
| 5,487,426 | A | 1/1996 | O'Hair | 166/378 |
| 5,492,174 | A | 2/1996 | O'Hair | 166/241.4 |
| 5,511,619 | A | 4/1996 | Jackson | 166/369 |
| 5,821,414 | A | 10/1998 | Noy et al. | 73/152.54 |
| 5,914,596 | A | 6/1999 | Weinbaum | 324/228 |
| RE36,362 | E | 11/1999 | Jackson | 166/369 |
| 6,152,223 | A | 11/2000 | Abdo et al. | 166/241.4 |
| 6,308,787 | B1 * | 10/2001 | Alft | 175/48 |
| 6,316,937 | B1 | 11/2001 | Evans | 324/220 |
| 6,349,779 | B1 * | 2/2002 | Gilbert | 175/323 |
| 6,386,292 | B1 * | 5/2002 | Bland | 166/387 |
| 6,405,808 | B1 * | 6/2002 | Edwards et al. | 175/45 |

(Continued)

OTHER PUBLICATIONS

Vaisberg et al., Fatigue of Drillstring: State of the Art, 2002, Oil & Gas Science and Technology—Rev. IFP, vol. 57, No. 1, pp. 7-37.*

*Primary Examiner*—Bryan Bui
*Assistant Examiner*—Toan M. Le
(74) *Attorney, Agent, or Firm*—Browning Bushman P.C.

(57) ABSTRACT

A wellbore evaluation system evaluates mechanical wear and corrosion to components of a well system including a production tubing string positionable in a well and a sucker rod string movable within the production tubing string. A deviation sensor determines a deviation profile of the well, a rod sensor senses and measures wear and corrosion to the sucker rod string as it is removed from the well to determine a rod profile, and a tubing sensor senses and measures wear and corrosion to the production tubing string as it is removed from the well to determine a tubing profile. A data acquisition computer is in communication with the sensors for computing and comparing two or more of the respective deviation profile, rod profile, and tubing profile as a function of depth in the well. A 3-dimensional image of wellbores, with isogram mapping, may be generated and examined over the internet.

41 Claims, 11 Drawing Sheets

U.S. PATENT DOCUMENTS 6,453,239 B1 9/2002 Shiraska et al. ..... 701/220
6,580,268 B1 6/2003 Wolodko ..... 324/240
6,704,656 B1 * 3/2004 Abriol et al. ..... 702/6

* cited by examiner

50

WELLBORE EVALUATION SYSTEM AND METHOD

FIELD OF THE INVENTION

The present invention relates to equipment and techniques to evaluate wellbore conditions. More particularly, the invention relates to improved techniques to evaluate wear and corrosion in a wellbore having a downhole pump driven by a sucker rod powered at the surface.

BACKGROUND OF THE INVENTION

Oil and gas wells are typically drilled with a rotary drill bit, and the resulting borehole is cased with steel casing cemented in the borehole to support pressure from the surrounding formation. Hydrocarbons may then be produced through smaller diameter production tubing suspended within the casing. Although fluids can be produced from the well using internal pressure within a producing zone, pumping systems are commonly used to lift fluid from the producing zone in the well to the surface of the earth. This is often the case with mature producing fields where production has declined and operating margins are thin.

The most common pumping system used in the oil industry is the sucker rod pumping system. A pump is positioned downhole, and a drive motor transmits power to the pump from the surface with a sucker rod string positioned within the production tubing. Rod strings include both "reciprocating" types, which are axially stroked, and "rotating" types, which rotate to power progressing cavity type pumps. The latter type is increasingly used, particularly in wells producing heavy, sand-laden oil or producing fluids with high water/oil ratios. The rod string can consist of a group of connected, essentially rigid, steel or fiberglass sucker rod sections or "joints" in lengths of 25 or 30 feet. Joints are sequentially connected or disconnected as the string is inserted or removed from the borehole, respectively. Alternatively a continuous sucker rod (COROD) string can be used to connect the drive mechanism to the pump positioned within the borehole.

A number of factors conspire to wear down and eventually cause failure in both sucker rods and the production tubing in which they move. Produced fluid is often corrosive, attacking the sucker rod surface and causing pitting that may lead to loss of cross-sectional area or fatigue cracking and subsequent rod failure. Produced fluid can also act like an abrasive slurry that can lead to mechanical failure of the rod and tubing. The rod and tubing also wear against each other. Such wear may be exacerbated where the well or borehole is deviated from true vertical. Even boreholes believed to have been drilled so as to be truly vertical and considered to be nominally straight may deviate considerably from true vertical, due to factors such as drill bit rotational speed, weight on the drill bit, inherent imperfections in the size, shape, and assembly of drill string components and naturally-occurring changes in the formation of the earth that affect drilling penetration rate and direction. Also, some boreholes are intentionally drilled at varying angles using directional drilling techniques designed to reach different parts of a hydrocarbon-producing formation. As a result, sucker rods and production tubing are never truly concentric, especially during the dynamics of pumping, and instead contact one another and wear unpredictably over several thousand feet of depth. Induced wear is therefore a function of many variables, including well deviation from true vertical; angle or "dogleg" severity; downhole pump operating parameters; dynamic compression, tensile and sidewall loads; harmonics within the producing sucker rod string; produced solids; produced fluid lubricity; and water to oil ratio. Additionally, in certain conditions, such as in geologically active areas or in areas of hydrocarbon production from diatomite formations, wellbores may shift over time, causing additional deviation from vertical.

For many years it has been possible to determine the deviation of a borehole, or wellbore, from true vertical. Such techniques are used extensively in the drilling of new wellbores, either as periodic "single shot" surveys, "multi-shot" surveys or even continuously while drilling, known as "MWD". U.S. Pat. No. 6,453,239 to Shirasaka, et al, U.S. Pat. No. 5,821,414 to Noy, et al, U.S. Pat. No. 4,987,684 to Andreas, et al and U.S. Pat. No. 3,753,296 to Van Steenwyk, disclose such examples of surveying wellbores. However, in the case of most existing rod-pumped oil wells, any such surveys performed during the original drilling of the well largely comprised periodic surveys of wellbore direction and inclination performed only at one or two key intervals during the well-drilling operation. Consequently, a continuous profile of the wellbore deviation, giving rise to tubing and rod wear, is not generally known. Alternatively, performing a dedicated, continuous directional survey of existing wellbores, such as those contemplated in the above patents, is generally cost-prohibitive. There is a need for a cost-effective directional survey that can be integrated into well work-over operations of existing producing wellbores to obtain an accurate, nearly continuous deviation profile and allow mitigation of rod and tubing wear.

Failure of pumped oil wells due to the cumulative effect of the wear of sucker rods on tubing and such wear combined with corrosion is considered to be the single largest cause of well down time. Generally accepted methods of mitigating such wear include installing rod guides to centralize the sucker rod in the tubing with selected tubing surface contact materials; sinker bars to add weight to the sucker rod string; tubing insert liners composed of wear-resistant materials such as nylon and polythene; and improving operational practice. Examples of rod guides are disclosed in U.S. Pat. No. 6,152,223 to Abdo, U.S. Pat. No. 5,339,896 to Hart, U.S. Pat. No. 5,115,863 to Olinger, and U.S. Pat. Nos. 5,492,174 and 5,487,426 to O'Hair. An example of a tubing liner insert is U.S. Pat. No. 5,511,619 to Jackson. Since many of these mitigation techniques are expensive to apply, oil well operators must carefully assess the economics of any such mitigation techniques.

Although wear can be mitigated, it cannot be eliminated, so inspection of sucker rods and production tubing are common in the industry. Well operators within the industry commonly follow a "run until failure" approach, only inspecting components upon failure of some element of the wellbore, which may include a hole or split in the tubing, pump failure, rod failure, or tubing separation. The nature of the industry is that down-time is costly, both in terms of lost or deferred production and the actual cost to repair the failure by work-over of the wellbore. Another reason well operators are reluctant to perform inspections at regular intervals is that the diagnostic capabilities of current inspection practices are somewhat limited. A more useful, reliable, and economical method of wear and corrosion pattern analysis and diagnosis that gives rise to mitigation opportunities would allow operators to be more proactive. Further, many operators are unable to devote the time and human resources to perform the necessary analysis of data such as well deviation, rod failure and tubing failure.

The most basic wear analysis techniques include simply observing the wear patterns contained within the individual lengths of oil well production tubing, to empirically inspect tubing for wall thickness loss due to mechanical wear and corrosion of sucker rods and tubing. Caliper surveys are available to measure the inside diameter of production tubing but cannot examine the condition of the outside condition of the tubing.

More sophisticated inspection techniques employ magnetic sensor technologies to assess the condition of production tubing. Magnetic testing devices have been known for many years, as disclosed in U.S. Pat. No. 2,555,853 to Irwin and more specifically for oilfield tubulars and sucker rods in U.S. Pat. No. 2,855,564 to Irwin for a Magnetic Testing Apparatus and Method. Applying this technology to the inspection of oilfield tubulars, U.S. Pat. Nos. 4,492,115, 4,636,727 and 4,715,442 to Kahil et al. disclose tubing trip tools and methods for determining the extent of defects in continuous production tubing strings during removal from the well. The tools and methods include magnetic flux leakage sensor coils and Hall-effect devices for detecting defects such as average wall thickness, corrosion, pitting, and wear. One or more of the Kahil tools further include a velocity and position detector, for correlating the location of individual defects to their locations along the tubing string. A profile of the position of the defects in the continuous string can also be established.

U.S. Pat. No. 4,843,317 to Dew discloses a method and apparatus for measuring casing wall thickness using an axial main coil for generating a flux field enveloping the casing wall. U.S. Pat. No. 6,316,937 to Edens discloses a combination of magnetic Hall effect sensors and digital signal processing to evaluate defects and wear. U.S. Pat. No. 5,914,596 to Weinbaum discloses a magnetic flux leakage and sensor system to inspect for defects and measure the wall thickness and diameter of continuous coiled tubing. All of these systems induce magnetic flux within the tubing. Surface defects result in magnetic flux leakage. Sensors measure the leakage and are thereby used to locate and quantify the surface defect.

Techniques are also known for magnetically inspecting sucker rods. Conventional sucker rod segments are commonly removed from an oil well, separated, and trucked to inspection plants to be "reclaimed". U.S. Pat. No. 2,855,564 to Irwin discloses a magnetic testing apparatus used in inspection of sucker rods, and U.S. Pat. No. 3,958,049 to Payne discloses an example of a process for reclaiming used sucker rod. In the latter patent, the salvaged rod is degreased, visually inspected, subjected to a shot peening operation, and analyzed for structural imperfections. Magnetic induction techniques are employed, albeit at an inspection plant, rather than on-site. A system for evaluating a coiled sucker rod string, or "COROD", as it is pulled from a well is disclosed in U.S. Pat. No. 6,580,268 B2 to Wolodko. Defects within the COROD may be correlated with their position. The system generates "real time" calculated dimensional display of the COROD and cross sectional area as a function of position. Wireless technology can be used, such as to convey signals from a processor unit as many as 200 feet to a laptop server.

Certain aspects of the sucker rod and production tubing inspection techniques discussed have a certain level of sophistication, such as the use of wireless technology and digital signal processing. Ironically, however, the analyses derived from the resulting data are relatively limited and shortsighted. The data obtained is not optimally used to correct or mitigate wear. For example, the end result of conventional sucker rod inspection and reclamation is the rather simplistic determination of whether to re-classify and reuse or dispose of each rod.

Additionally, because the production tubing in most rod-pumped producing wells is tubing that has previously been used in other wells or from such reclaimed supplies, pre-existing wear patterns on tubing alone are often misleading as to the root causes of tubing wear in the current wellbore. Further, even a detailed, positional analysis of defects does not provide an adequate window as to their root cause or mitigation. For example, in general, well operators simply reposition rod guides, which may merely shift wear on the rod or tubing to another position along the string. An alternative technique to mitigate rod wear on tubing is disclosed in U.S. Pat. No. 36,362E to Jackson, whereby an abrasion resistant polymer, such as polyethylene, is inserted into the tubing. This technique, however, reduces the inside diameter of the tubing and does not assess the cause of tubing wear. As a result, the polythene liner may simply fail over time, rather than the tubing, which still necessitates work-over. Not even "real time" data reports provide an adequate solution to mitigating wear, because they do nothing to improve the quality or scope of the analysis, or correlate tubing condition information with rod condition information. An accurate analysis of the cause of wellbore failure due to tubing or rod failure is also aided with a profile of the wellbore deviation.

Another problem with existing inspection systems is that there is no available means of performing these assessments in a cost-effective and timely manner so that tubing wear can be mitigated through an economical solution specific to a well. Because quickly returning the well to production is of paramount importance, full analysis of any limited information available is often difficult, if not impossible, to perform before the well is returned to production.

The disadvantages of the prior art are overcome by the present invention. An improved system is provided for evaluating and mitigating one or more of wear and corrosion on rod strings and tubular strings.

SUMMARY OF THE INVENTION

A wellbore evaluation system and method are provided for evaluating one or more of wear and corrosion to certain critical components of a well system. The well system includes a production tubing string positionable in a well and a sucker rod string movable within the production tubing string. In one embodiment, two or more sensors are selected from the group consisting of a deviation sensor movable within the well to determine a deviation profile; a rod sensor for sensing and measuring wear, corrosion pitting, cross-sectional area and diameter of the sucker rod string as it is removed from the well to determine a rod profile; and a tubing sensor for sensing and measuring wear, cross-sectional area, corrosion pitting, and/or holes or splits in the production tubing string as it is removed from the well to determine a tubing profile. A computer system, which may broadly include a central server-computer, a data acquisition computer system, and circuitry connected to the individual two or more sensors, is in communication with the two or more sensors for computing and comparing two or more of the respective deviation profile, rod profile, and tubing profile as a function of depth in the well. The computer preferably compares all three of the deviation profile, rod profile, and tubing profile.

In one embodiment, the computer outputs a wear mitigation solution, which may include installing or repositioning rod guides with respect to specific depth zones of the sucker rod string, lining the production tubing string with a polymer lining at specific depths, employing a tubing rotator to rotate the production tubing string, employing a sucker rod rotator to rotate the sucker rod string, changing pump size, stroke or speed, changing the diameter of a section of the sucker rod string, or replacing one or more segments of the production tubing string or sucker rod string.

The computer may output a visual representation of the comparison of two or more of the deviation profile, rod profile, and tubing profile. The visual representation may include a graphical display of two or more of the deviation profile, rod profile, and tubing profile. The visual representation may also include a three dimensional plot of the deviation profile, accompanied by other rod wear and tubing wear data.

In some embodiments, the computer compares two or more of the deviation profile, rod profile, and tubing profile with two or more previously performed profiles. The computer may also compare one or more of the deviation profile, rod profile, and tubing profile from the well system with profiles from another well, such as in a field of wells.

In one embodiment, a marking method is included for marking segments of one or both of the production tubing string and the sucker rod string when pulled from the well. A tracking device is responsive to the markings on the segments as they are inserted into the well, and a computer is in communication with the tracking device for tracking the relative position of each of the segments of the respective production tubing string and sucker rod string. Typically, the markings will comprise bar code markings, and the tracking device will comprise a bar code reader for reading the bar code markings.

The deviation sensor preferably comprises three pairs, each of an accelerometer and a gyroscope. The rod sensor preferably comprises one or more of a magnetic flux sensor, Hall-effect sensor, an LVDT, and a laser micrometer. The tubing sensor comprises one or more of a magnetic flux sensor and a Hall-effect sensor.

Some embodiments include a plurality of differently sized sensor inserts for accommodating a plurality of diameters of the sucker rod string and production tubing. Each sensor insert may include the rod sensor and tubing sensor. A sensor barrel selectively receives each of the differently sized sensor inserts.

The rod sensor typically senses and measures a coupling that joins segments of the sucker rod string, diameter of the coupling, and then measures one or more of wear to a rod guide, rod diameter, rod cross-sectional area, and pitting. The tubing sensor typically senses and measures one or more of tubing wear cross-sectional area, wall thickness, and pitting. The deviation sensor typically senses and measures one or more of wellbore dogleg severity, inclination angle, change in inclination angle and azimuth.

In some embodiments, the wear evaluation system is tailored to specifically evaluate one or more of wear and corrosion to segmented rod strings as they are pulled from the well by a workover rig. Segmented rod strings include multiple segments coupled with larger diameter couplings. Magnetic sensing devices and/or laser micrometers are radially spaced from the rod string, such that they do not interfere with the larger diameter couplings.

The foregoing is intended to give a general idea of the invention, and is not intended to fully define nor limit the invention. The invention will be more fully understood and better appreciated by reference to the following description and drawings.

DETAILED DESCRIPTION OF THE PREFERRED EMBODIMENTS

Figure 1:
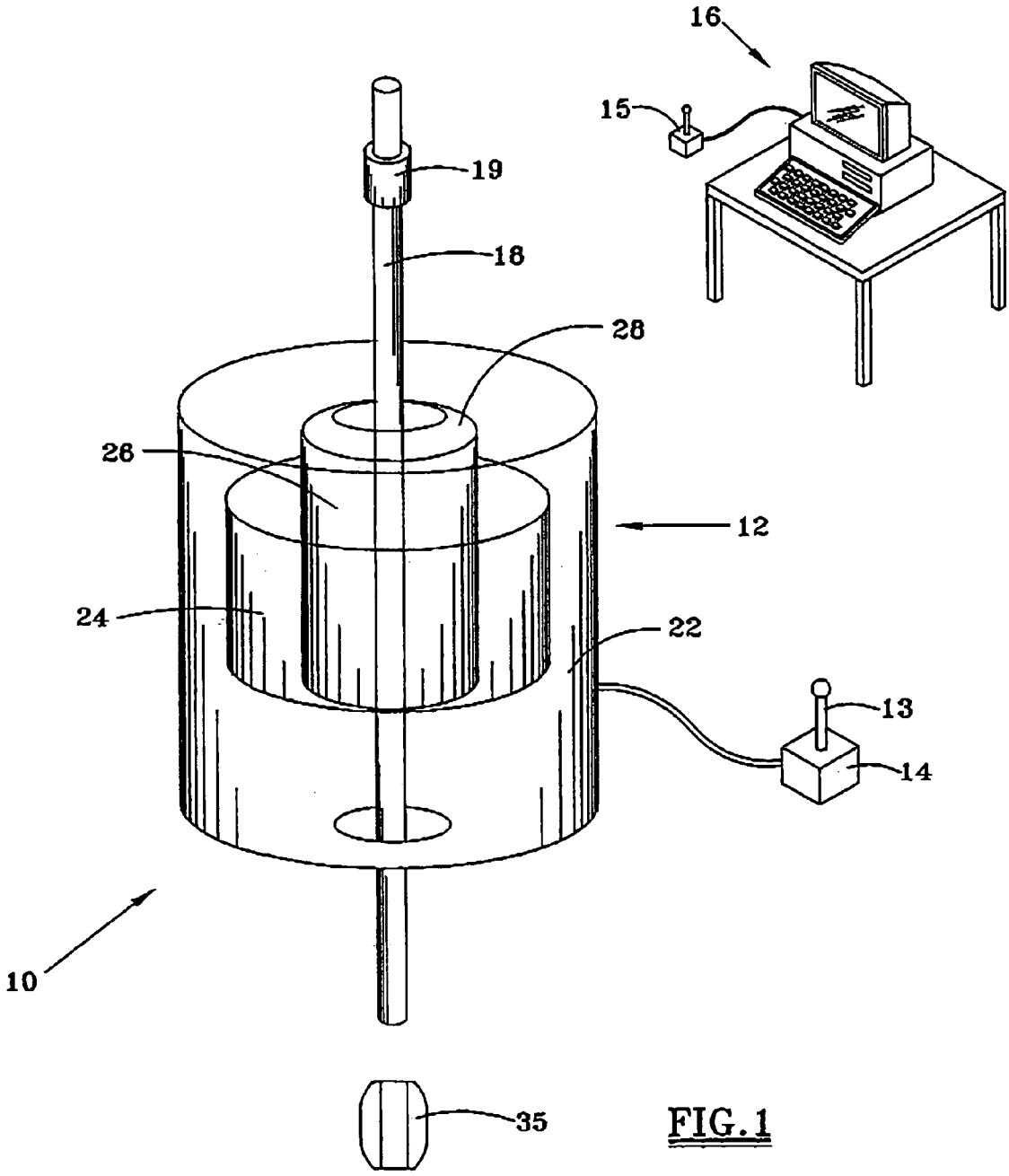
FIG. 1 conceptually illustrates a preferred embodiment of the wear evaluation system including a removable sensor insert for sensing a segmented, coupled sucker rod string being pulled from the well.

A preferred embodiment of a wear evaluation system is indicated generally at 10 in FIG. 1. An embodiment of sensor package 12 including a rod sensor and tubing sensor is detailed further in FIG. 2. The sensor package 12 may be positioned on a rig floor. A deviation sensor 28 is detailed further in FIG. 3, as it is dropped to the bottom of well 7 in the production tubing string 20 by gravity or lowered on wireline 32 through tubing string 20. The system 10 evaluates wear, corrosion pitting, cross-sectional area and certain diameters of components of a well system that includes a segmented production tubing string 20 positionable in well 7 and a segmented sucker rod string 18 movable within the production tubing string 20. Segmented sucker rod string 18 has multiple segments coupled together with larger diameter couplings 19, although a sucker rod string may alternatively be a continuous rod or "COROD". Sucker rod strings may include both reciprocating type rods, which reciprocate axially in a well, or rotating type rods, which rotate to power a progressive cavity pump. System 10 may be a portable and/or truck-mounted field unit. Sensor package 12 and deviation sensor 28 both communicate with data acquisition computer system 14, and thereby with server computer system 16 to compute and compare information such as (i) the wellbore deviation; (ii) the condition of the tubing 20 in terms of holes, splits, corrosion pitting, rod wear, cross sectional area and other wall-thickness reducing flaws; (iii) the condition of the sucker rod 18 in terms of pitting, wear, cross-sectional area and diameter; (iv) the condition of the couplings 19 in terms of diameter and wear; and (v) the condition of rod guide 35 in terms of diameter and wear. These criteria are computed as a function of depth within the wellbore in the form of profiles, such as a deviation profile, a rod profile, and a tubing profile, and the existence and severity of the criteria are correlated by comparing the profiles.

Correlation of these criteria is vastly more useful than merely determining the individual profiles. For example, analysis of wear detected on the inside surface of tubing 20 alone, without depth-correlated wear to rod 18 or rod coupling 19, at a depth where the deviation profile shows the wellbore to be vertical and straight may indicate that the observed tubing wear is unrelated to this particular wellbore. Alternatively, detection of rod wear on the tubing consistent with and related to sucker rod couplings diameter loss at the same depth, over several hundred feet, in an area where there is a measured material inclination from vertical, would indicate that rod guides would very effectively mitigate tubing wear and thereby extend well production time. Such a correlation analysis is essential for the accurate identification of the root cause of the condition and may only be performed with sufficient data.

A variety of sensor types are available for use with the sensor package 12. In FIG. 1, sensor package 12 includes an outer barrel 22, which acts as an enclosure for internal assemblies such as magnetic coil 24 fixed to the outer barrel 22. A sensor insert 26 is removably inserted into barrel 22. Sensor insert 26 typically includes one or more of magnetic flux leakage sensor coils or Hall-effect sensors, linear variable differential transformers (LVDT), and laser micrometers. The sensor insert 26 may be positioned centrally about either the sucker rod 18 or production tubing 20, and may be selected from a group of differently sized inserts for accommodating a variety of rod or tubing diameters. Thus, the sensor package 12 may house both the rod sensor and the tubing sensor.

The rod sensor may obtain data such as wear to the coupling 19 that joins segments of the sucker rod string 18, minimum measured diameter of the coupling 19, wear to a rod guide 35, rod diameter, rod cross-sectional area, and rod pitting. Likewise, the tubing sensor may obtain data such as tubing wear, wall thickness, cross-sectional area and pitting. The deviation sensor 28 may obtain data such as wellbore dogleg severity, inclination angle, change in inclination angle along the well, and azimuth.

The rod profile is typically obtained first, the deviation profile second, and the tubing profile third. In a preferred embodiment, the deviation profile is obtained simultaneously with the tubing profile as the tubing is pulled from the well. First, the sucker rod 18 under inspection is pulled from the well by a work-over rig (not shown). As the rig pulls the rod 18, the characteristics of the rod 18 are sensed and measured to determine the rod profile. Data acquisition computer system 14 receives signals from the sensor package 12 and transmits them to the server computer 16. Data acquisition computer system 14 may compute the profiles prior to transmitting to server computer 16, where after the server computer 16 may act as a server. The transmittal between data acquisition computer system 14 and server computer 16 may be by wire, or alternatively by one of a variety of wireless communication technologies known in the art, as conceptually represented by antennas 13 and 15.

Second, after the sucker rod string 18 has been removed from the well 7, a gyroscope & accelerometer-based deviation sensor tool 28 is dropped to the bottom of the well 7 inside the tubing 20. Alternatively, the deviation sensor 28 may be lowered to the bottom of the well 7 on wireline 32. The deviation tool 28 measures and records inclination, rate of change of inclination and azimuth of the wellbore as the tool 28 is retrieved in the tubing by the work-over rig, or retrieved independently by wireline 32. The tool memory is downloaded into the data acquisition computer system 14 to compute and further process the deviation profile, comparing it with the rod profile and/or tubing profile. This information is also transmitted to server computer 16 for further processing as to the optimum wellbore wear mitigation solution.

Third, the production tubing string 20 is pulled from the well by the work-over rig and inspected similarly to the sucker rod string 18. As the rig pulls the tubing 20, the characteristics of the tubing 20 are sensed to determine the tubing profile. As with the rod string 18, the data acquisition computer system 14 receives signals from the sensor package 12, computes the tubing profile and transmits the information to the server computer 16. At least a portion of this computation may again be carried out by the data acquisition computer system 14.

Having acquired, processed, displayed, recorded and compiled the data, the server computer 16 may then act as a server. This server-computer 16 stores all the raw data, then applies the received information with a software program to calculate a mathematical model of wear to the well system. The model applies correlative techniques and other algorithms to determine a comprehensive wellbore condition profile. The server-computer 16 may then determine an optimal solution for the mitigation of wear within the well 7. The solution may be stored in the computer, acting as a central server, and then optionally transmitted back to the field unit, such as to data acquisition computer system 14, and made available for access over the internet to the appropriate personnel. The server computer 16 may thus be located several hundred feet, or several thousand miles away, enabled by internet and wireless technologies, such as satellite internet access. This is especially useful for management of a field of multiple wells. The server-computer 16 may store wear data for a multitude of wells, providing the convenience of one central processing location, and the ability to correlate not only the rod, tubing, and deviation data from one well, but to correlate like data from the multitude of other wells in common areas, such as to establish or identify patterns or trends common to more than one well within a producing property lease or field.

Figure 4:
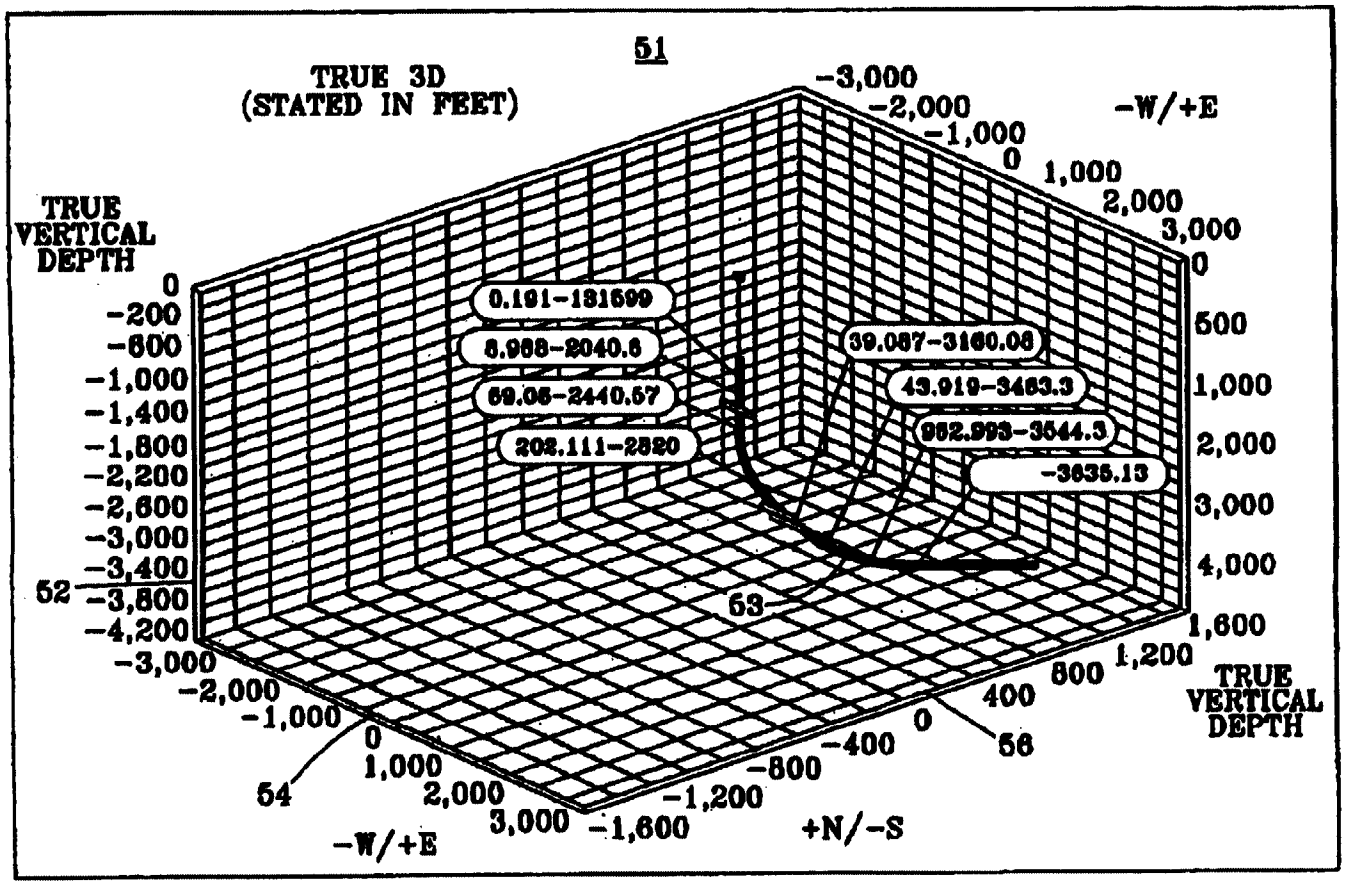
FIG. 4 conceptually illustrates a three-dimensional plot of the wellbore, along with rod wear and/or tubing wear data.
Figure 5:
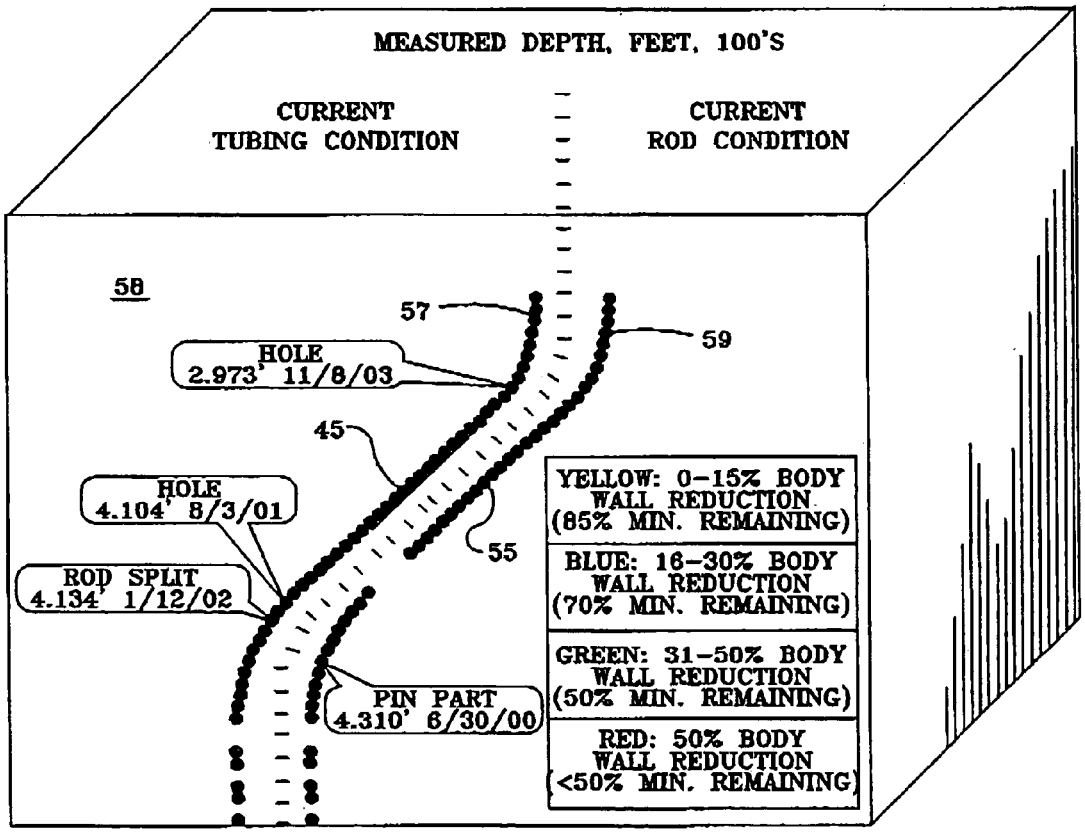
FIG. 5 conceptually illustrates another plot of the wellbore, along with rod wear and/or tubing wear data.

Having been stored on the server computer 16, all the data assembled in the rod profile, tubing profile, and deviation profile may be communicated and analyzed by means of a graphical database, in countless formats. For instance, the individual profiles may simply be displayed individually in a two-dimensional display. Such a display would only minimally show a correlation between the data, in that all three profiles may be viewed independently, without interrelating them. To provide a more useful analysis, the data from the three profiles is preferably correlated, in that data from one profile is related to data from another profile. As shown in FIG. 4, for example, a three-dimensional display 50 may be viewed on a screen 51, comprising a plot 53 of the wellbore's physical path or deviation profile, where a vertical axis 52 represents depth of the well, and two horizontal axes 54, 56 define a plane parallel with the earth's surface above at the well site. Critical areas of the wellbore plot 53 may be graphically identified or labeled with the rod data and/or tubing data. The plot 58 of FIG. 5 shows another plot example, wherein one wellbore deviation profile 57 is displayed and labeled with tubing data, and another wellbore deviation profile 59, identical to profile 57, is labeled with rod wear data. Many other types of display are possible, wherein data from two or more of the rod profile, tubing profile, and deviation profile is plotted, compared and interrelated.

Figure 11:
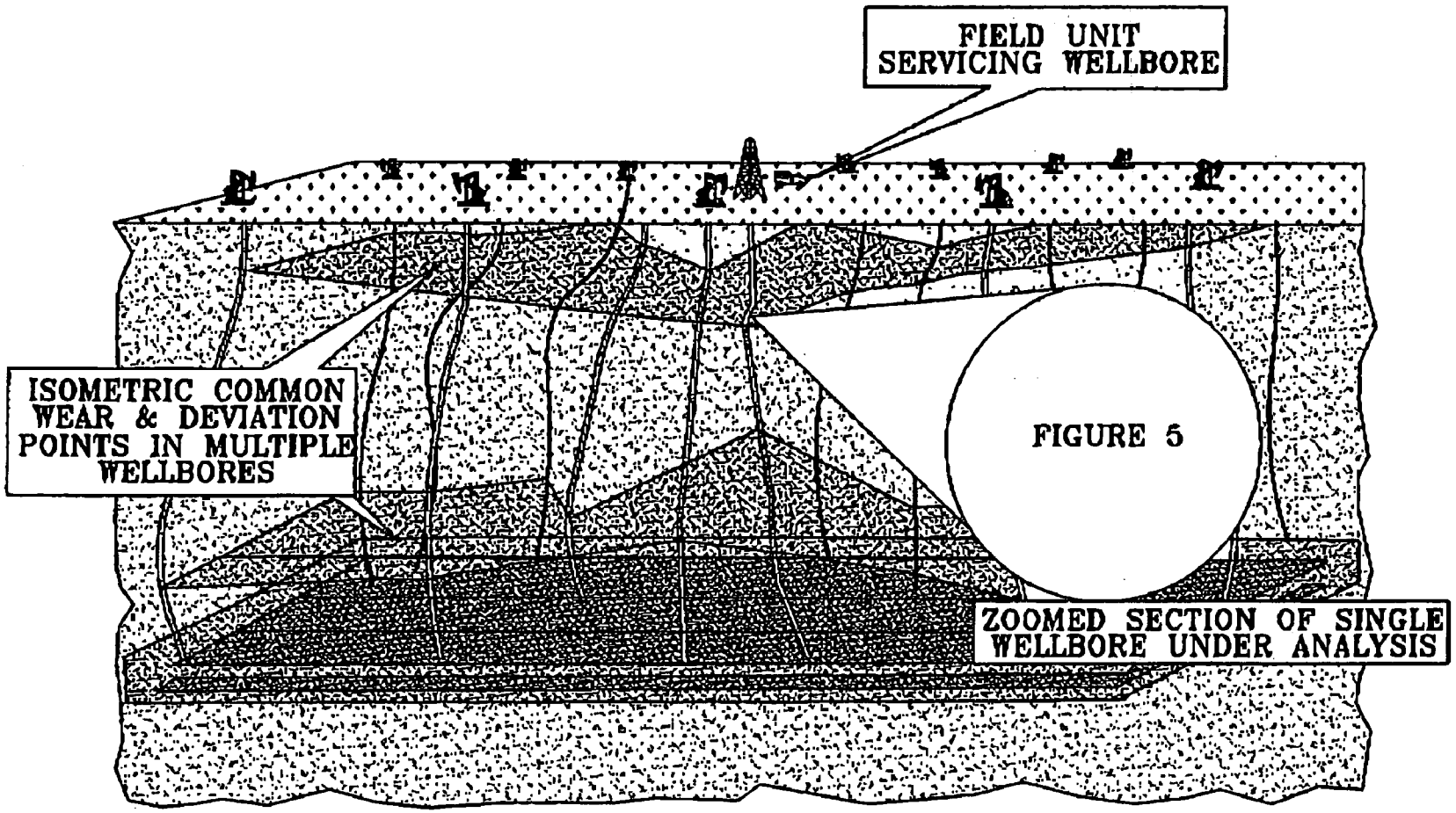
FIG. 11 conceptually illustrates a 3-dimensional image of a producing area lease or field, including the surface location, depth, deviation, as to both inclination and azimuth, rod condition and tubing condition.

It is a benefit of the present invention that conditions of multiple wellbores within a common producing field, lease, or area may be correlated and imaged, such as by using color-based common data isogram mapping, which may be applied to a visual display such as shown in FIG. 11. The database also allows for comparison to other databases having historical operational failure data for the multiple wellbores. The entire volume of information relevant to the failure history, root cause of the failure, tubing profile, deviation profile and rod profile may be stored, analyzed, correlated and graphically presented. This entire database can be investigated by any authorized user with internet protocol access, as well as displayed at the field. This feature allows for a rapid, graphic display of relevant wellbore conditions both in specific wellbores and multiple wellbores within the producing area lease or field. The optimum wellbore wear mitigation solution is generated and readily displayed and analyzed at any location, as well as in the mobile field unit containing data acquisition computer system 14. An operator may thus rapidly implement the wellbore wear mitigation solution before the well is put back into production.

Figure 2:
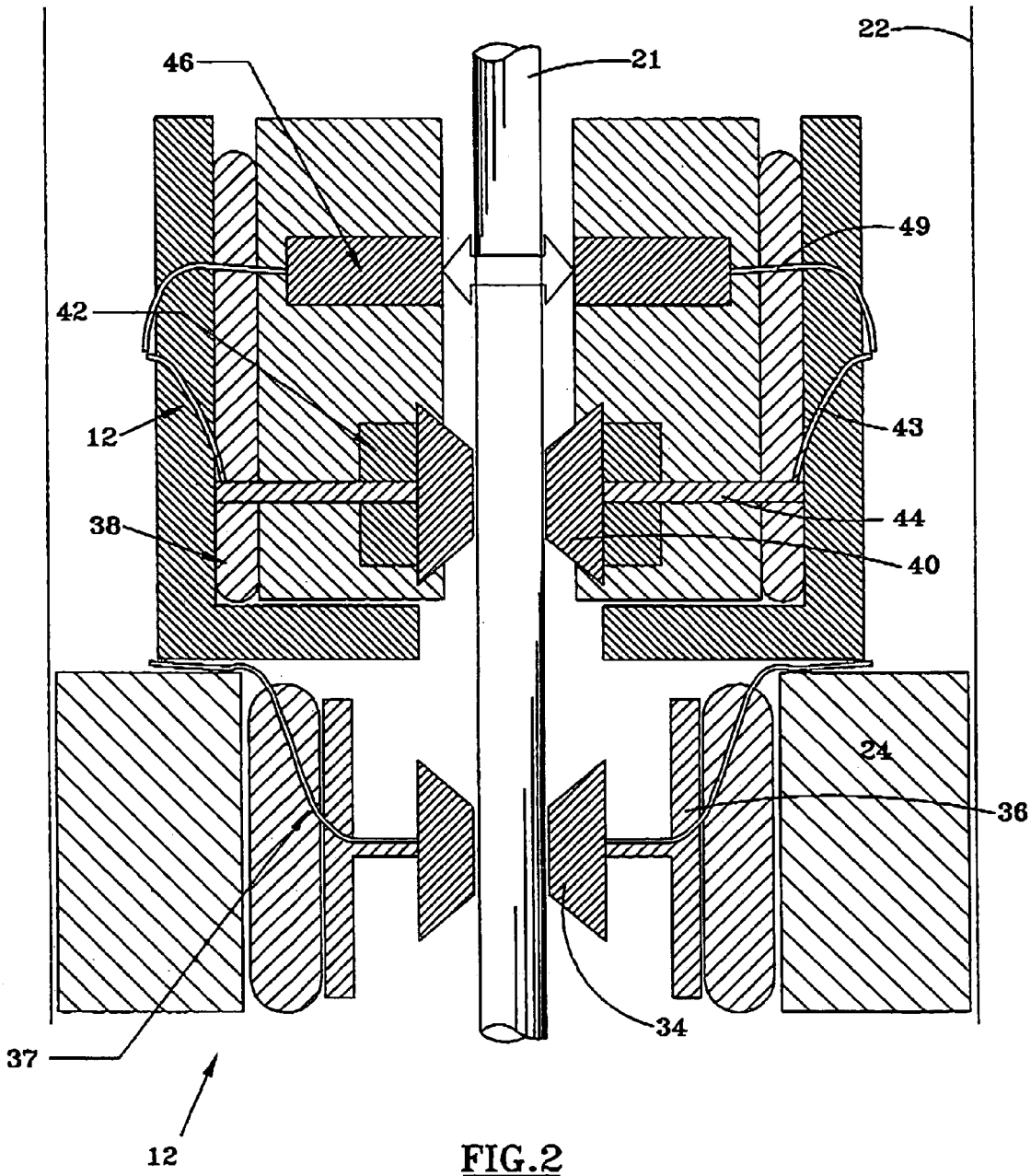
FIG. 2 conceptually illustrates some of the components that may be included with the sensor package, including a magnetic flux leakage sensor coil, a hall-effect device, an LVDT, and a laser micrometer.

FIG. 2 details one embodiment of sensor package 12. A generic cylindrical member 21 represents either the rod string 18 or tubing string 20 being examined. Many elements of the wear evaluation system 10 are generally known. For example, magnetic flux leakage sensor coils and Hall effect sensors are known in the art to detect and measure changes in magnetic flux density caused by corrosion pitting, wall thickness change, cross-sectional area change and fatigue cracks on production tubing, sucker rods and on COROD sucker rods. Magnetic sensors are also known for detecting area and changes in area of COROD, and diameter or change in diameter of rod and tubing. LVDTs are also generally known in the art for determining diameter and thickness of specimens. Magnetic coil 24 is radial spaced from tubing 20 or rod 18, to magnetically energize the tubing 20 or rod 18 without touching them. Magnetic sensor shoes 34 are radially movable with respect to tubing 20 or rod 18 via floating, bidirectional sensor shoe mount assembly 36. The floating shoe mount assembly 36 allows freedom of movement as the irregular surface of the tubing 20, rod 18 or coupling 19 pass through it. The sensor shoes 34 may contain magnetic flux sensor shoes or Hall-effect devices to sense flux leaking from the rod 18 or tubing 20, generating signals in response. Signal wire 37 passes signals from the shoes 34 to the data acquisition computer system 14 or elsewhere in the sensor package 12.

Above the magnetic coil 24 in FIG. 2 is LVDT 44. Another contact shoe 40 floats along the rod 18 or tubing 20, moving radially in response to the diameter of the rod 18, coupling 19 or rod guide 35. The signals are output via signal wire 43 to the data acquisition computer system 14 or elsewhere within the sensor package 12.

Above the LVDT in FIG. 2 is a laser micrometer and receiver pair 46 for measuring the diameter or change in diameter of sucker rods, sucker rod couplings, and sucker rod guides. Although laser micrometers are known generally, their application to determining diameter of a rod as it is pulled from a well is novel. Power and signal wire 49 powers the laser micrometer and receiver pair 46 and passes signals to the data acquisition computer system 14 or elsewhere within the sensor package 12.

In FIG. 2, sensor insert 26 is shown to house both the LVDT 44 and laser micrometer 46. The sensor insert 26 may be changed out to accommodate various diameters of rod and tubing. For example, the insert 26 shown may be suitable for ⅝", ¾", ⅞", or 1" rods, and a larger insert may be inserted into barrel 22 for rods greater than 1" or for tubing. The magnetic coil 24 in this embodiment is not included within the sensor insert 26.

The sensor package 12 of FIG. 2 is conceptual and not to scale, for the purpose of illustrating its features. If constructed with the proportions shown, the couplings 19 for coupling sucker rods 18 may interfere with floating shoes 34 and 40. When passing coupled rod string 18 through the sensor package 12, it may therefore be necessary to move the shoes 34, 40 outwardly, to prevent this interference. Accordingly, suspension system 38, consisting of pneumatic bladder or cylinder elements or alternatively, springs, is used to allow this outward radial movement. Magnetic sensor coil and Hall-effect device shoes 34 may be radially spaced to remotely detect wear to the rod string 18 and couplings 19, such as from 0.25" from the rod or tubing surface, to prevent interference with the couplings 19. Further, because the laser micrometer 46 is capable of remotely sensing the rod, use of the laser micrometer 46 may obviate the need for the LVDT 44. A major advantage of using laser micrometer 46 over prior art diameter measurement systems is this ability measure the considerable variance in diameter of rod string 18, coupling 19 or guide 35 without touching them.

Figure 3:
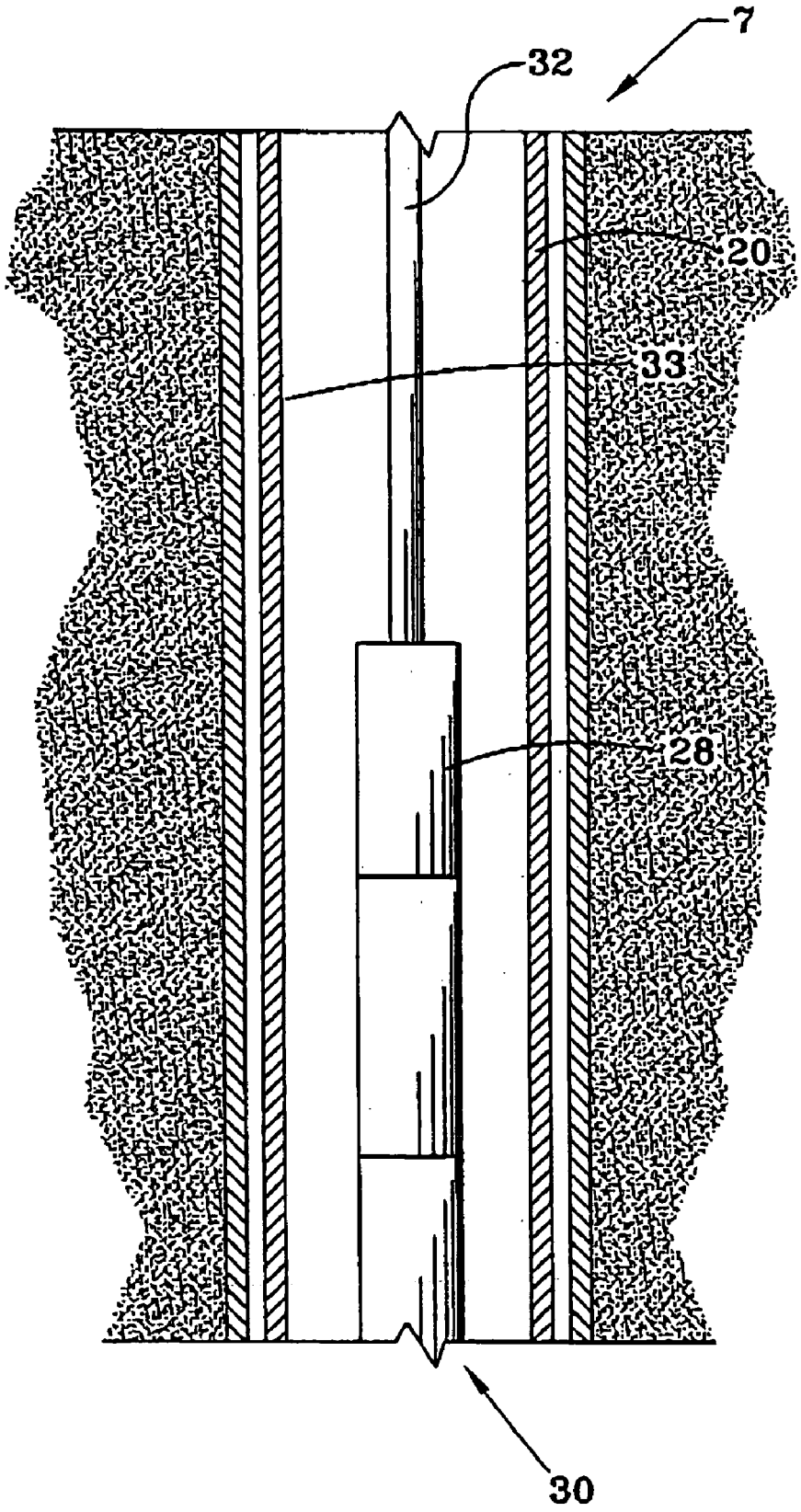
FIG. 3 conceptually illustrates a portion of a well in which casing is cemented, with the production tubing string suspended within the casing, and the deviation sensor being moved through the wellbore within the tubing.

The deviation sensor 28 in FIG. 3 may comprise as many as three or more pairs of an inclinometer and a gyroscope, both known in the art. The inclinometer is a lower cost, accelerometer-based device that generally provides only inclination angle data. The gyroscope may additionally provide azimuth data, which could detect, for example, a corkscrew deviation that may be undetectable solely with the inclinometer. Conventional gyroscopes, however, are typically a far more expensive devices. Although the additional information provided by a gyroscope is useful, lower cost gyroscope technologies are currently sought.

The deviation sensor tool 28 may contain three sets of paired micro electrical-mechanical systems (MEMS) Coriolis-effect angular rate gyroscope and accelerometer devices known in the art of inertial navigation and shock measurement. Such devices are not known to have been employed in surveying existing, producing oil and gas wellbores for obtaining a deviation profile. Each pair of MEMS gyroscope and accelerometer devices, respectively, is triaxially positioned orthogonally to each other in the planes X, Y and Z. By initializing the deviation sensor tool relative to an established frame of reference using conventional Cartesian coordinates with a Global Positioning System, and using onboard processing and memory, it is possible to integrate rate of angular change over time into position. The deviation sensor is thus able to record the inclination and the azimuth of an existing, producing wellbore. The present invention uses less robust, robust, lower operating temperature-capable mass produced Carioles-effect MEMS devices rather than expensive alternative technology Coriolis-effect gyroscopic devices so as to bring the cost below that of a MWD directional survey or multi-shot wireline survey performed during the drilling of a wellbore. By comparison, an entire wellbore evaluation according to the present invention, including computation of rod profile, tubing profile, and deviation profile, may be obtained for less than the cost of a conventional gyroscopic survey. This highlights an important advantage of the invention that, by comparison to current techniques, an exceedingly more comprehensive wellbore analysis for wear, corrosion and deviation can be performed at an affordable price.

The sensors detailed in the figures are exemplary only, for conceptually illustrating the components that may be included with the wear evaluation system 10. The structure of the sensors is less important than the selection and use of the sensors and the integration and correlation of the data from the sensors. As alluded to previously, the prior art has generally sensed wear of the individual components, such as rod string segments trucked to a remote rod reclamation facility; COROD strings as pulled from the well; tubing strings as pulled from the well; and limited wellbore deviation information obtained during the original drilling of the well The present invention correlates this information to obtain more comprehensive information than otherwise available upon separate analysis of the individual components, and performs this operation while all the components of the system remain at the well site. Thus, according to the invention, data from two or more sensors are selected from the group consisting of a deviation sensor movable within the well, either by the tubing as it is retrieved from the well or by wireline, to determine a deviation profile; a rod sensor for sensing wear, diameter, cross-sectional area and pitting of the sucker rod string, including couplings and guides, as it is removed from the well to determine a rod profile; and a tubing sensor for sensing wear, corrosion pitting and cross-sectional area of the production tubing string as it is removed from the well to determine a tubing profile. Some of these conceptually distinct sensors may be physically combined into a single sensor unit, such as sensor insert 26. Although analysis of even two of the profiles is useful, it is preferable in many applications to compute and compare all three of the deviation sensor, rod sensor, and tubing sensor information to determine a comprehensive wellbore profile. The server-computer 16 and/or data acquisition computer system 14 and/or logic circuits that may be contained within any of the individual sensors each may perform some subpart of this computation and comparison.

Integration and analysis of the rod, tubing and deviation profiles further allows for the computation of a wear mitigation solution to correct at least some aspect of performance of the well system. The wear mitigation solution can sometimes be derived by an operator upon viewing and analyzing data, such as displayed in graphical form in the display 50 of FIG. 4. However, such prior art requires an expensive deviation survey and does not include integration of tubing or rod conditions. Alternatively, the data acquisition computer system 14 and server computer 16 employed in the present invention provide a fast and comprehensive computation of the wear mitigation solution.

The wear mitigation solution may include strategically positioning rod guides 35 shown in FIG. 1 with respect to depth in the sucker rod string 18. In simple cases, an operator may simply move the rod guides 35 to locations where excessive wear in the tubing profile is observed. However, the observed tubing profile may be a result of wear induced in a well in which the tubing was previously employed and thus unrelated to wear patterns in this wellbore. Alternatively, under the present invention, the server computer 16 provides a more comprehensive solution, indicating for example a large number of wear locations for repositioning rod guides 35, based on correlations with other data such as the deviation profile. The wear mitigation solution may include lining the production tubing string 20 with a polymer lining 33, indicated conceptually between dashed break lines in FIG. 3. The solution may include using a powered tubing rotator to rotate the production tubing string 20, such as to better distribute wear within the circumference of the tubing string 20. A rod rotator may likewise be used to rotate the sucker rod string 18. The solution may further include changing pump size, stroke or speed; changing the diameter of a section of the sucker rod string 18; or replacing one or more segments of the production tubing string 20 or sucker rod string 18.

Figure 6:
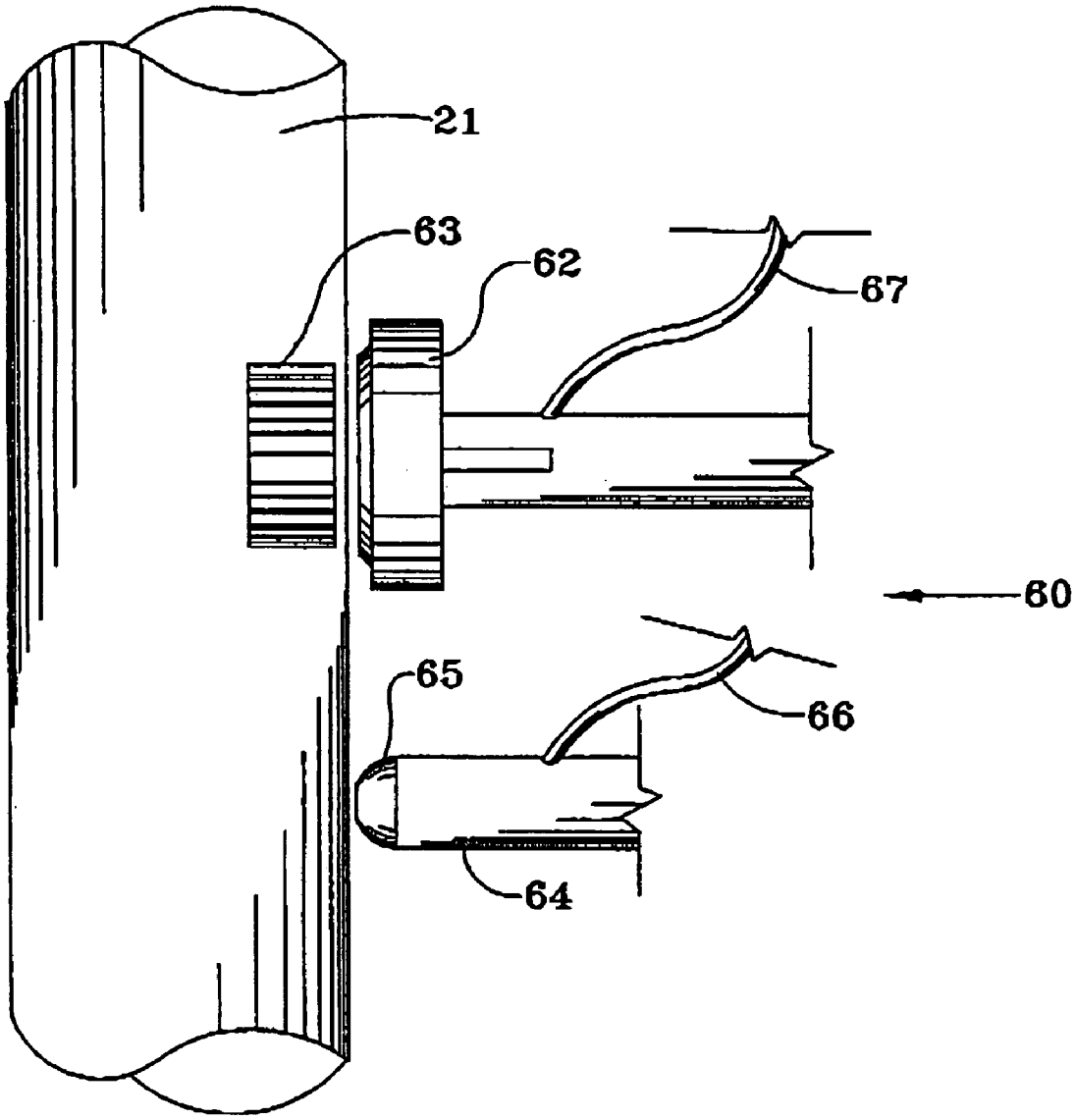
FIG. 6 conceptually illustrates a marking system, including a bar-code marking device for marking individual segments of the rod or tubing, and an optical reader for subsequently reading the bar codes, for tracking the individual segments.

The wear evaluation system 10 may further include a tracking system 60 detailed conceptually in FIG. 6. A marking device 62 may mark rod or tubing 21 with a bar code 63. In practice, the bar code 63 could be marked on an adhesive label as the surface of cylindrical member 21 is often rough, dirty, or otherwise incapable of directly receiving the bar code 63. A tracking device 64 includes optical sensor 65 for subsequently reading the bar code 63. The marking device 62 is preferably positioned above well 7 and marks individual segments of the production tubing string 20 and the sucker rod string 18 as they are pulled from the well 7. The tracking device 64 then reads the markings on the segments as they are reinserted into the well 7. A computer, which may be included within data acquisition computer system 14, is in communication with the tracking device 64 either wirelessly, or via wires 66, 67, for tracking the relative position of each of the segments of the respective production tubing string 20 and sucker rod string 18. The tracking system 60 thus allows the wear evaluation system 10, and specifically the server computer 16, to keep track of where individual segments are positioned within the tubing string 20 and sucker rod string 18. Because the segment positioning information gets stored in the server computer 16, it is of little consequence that the bar codes 63 may become illegible upon reinsertion into the well 7.

The tracking system 60 is useful when repositioning the individual joints of tubing, or rods and especially for future analysis of the elements of the same wellbore. For example, tubing joints having the greatest wear may be repositioned at the top of the string, and it is useful to keep track of this repositioning. Upon subsequent re-evaluation of the wellbore components at a later date, rod and tubing conditions may be compared and thus incremental wear and corrosion determined. Position information may be displayed along with other wear data. For instance, each tubing segment and rod segment may be represented respectively by one of dots 45 and 55 in FIG. 5. The dots 45 and 55 may be color coded, such as to represent their degree of wear. For example, tubing segments with 0–15% wall reduction (i.e. a minimum of 85% thickness remaining) may be represented by and displayed with a yellow dot, and placed at the lower end of the string; tubing segments with 16–30% wall reduction get a blue dot; segments with 31–50% wall thickness get a green dot; and segments with more than 50% thickness reduction get a red dot. A multiplicity of other coding and display schemes are conceivable.

Another aspect of the invention provides the significant advantage of evaluating rod wear to segmented sucker rod string 18 in the field. Prior art has been limited to disassembling segmented rod strings and evaluating them off-site, due to interference by the larger diameter couplings 19. According to one specific embodiment of the invention, a rod wear evaluation system 10 comprises a rod sensor included with sensor package 12 for sensing wear to the sucker rod string 18 as it is removed from the well 7 to determine a rod profile. Referring to FIG. 2 for illustration, the rod sensor 12 may comprise a magnetic flux sensor, including magnetic coil 24 and magnetic sensor shoes 34. The rod sensor 12 may also comprise a laser micrometer, including laser micrometer and receiver pair 46. According to this specific embodiment for evaluating segmented rod string 18, LVDT 44 is not included. The magnetic flux leakage sensor coil and Hall-effect device, 34 and laser micrometer 46 are radially spaced from the rod string 18 and couplings 19 to remotely sense the diameter, wear, cross-sectional area and pitting of the sucker rod string 18. The data acquisition computer system 14 is in communication with the rod sensor 12 for computing the rod profile. Again, a plurality of differently sized sensor inserts 26 may be included for accommodating a plurality of diameters of the segmented sucker rod string 18, each sensor insert 16 including the rod sensor. Sensor barrel 22 optionally receives sensor insert 26. This embodiment senses and measures one or more of the presence of the couplings 19, wear to the couplings 19, diameter of the couplings 19, diameter of rod guide 35, rod diameter, rod cross-sectional area, and pitting.

Figure 7:
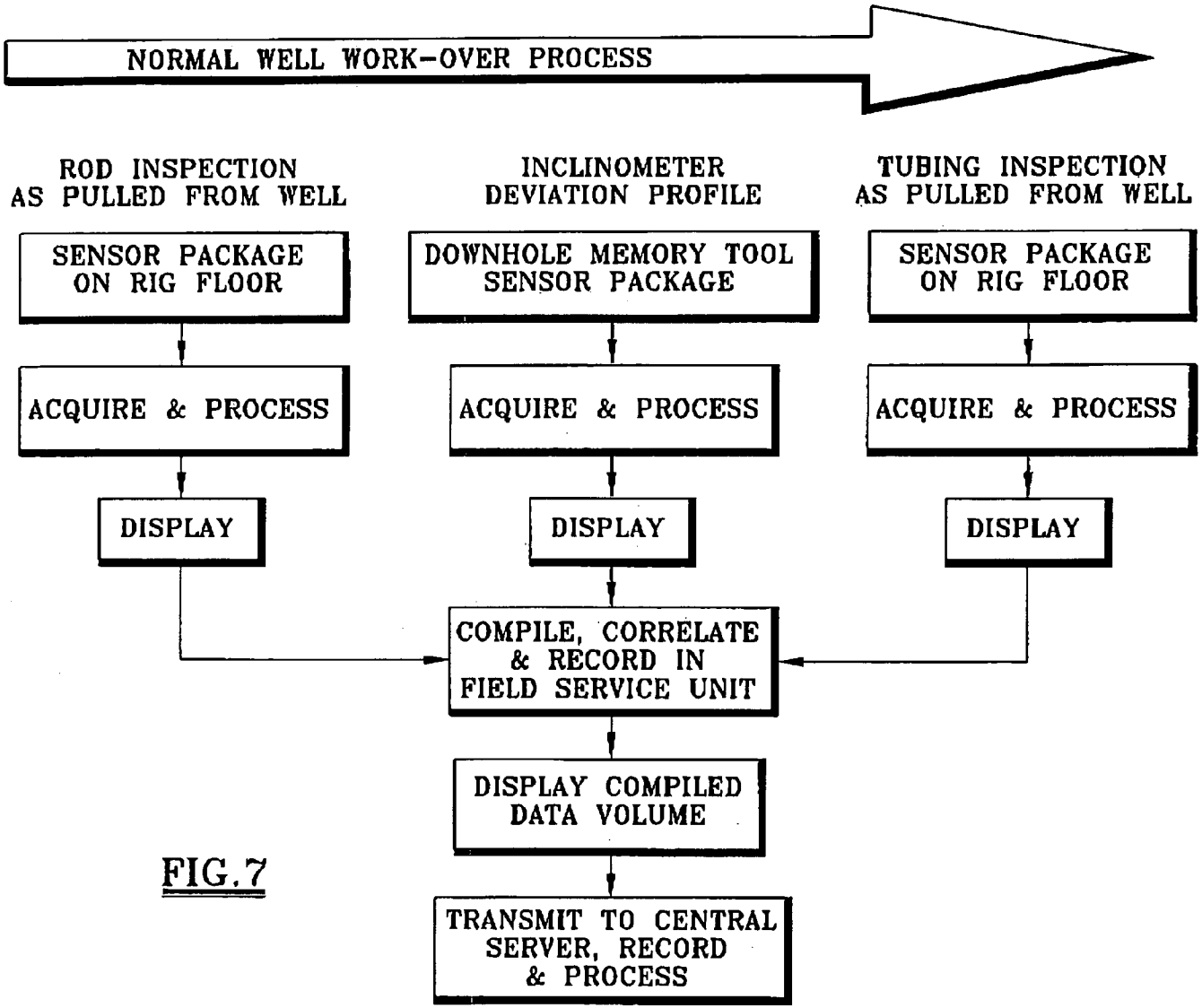
FIGS. 7–10 are flow diagrams conceptually illustrating examples of preferred operation of the wear evaluation system.

FIGS. 7–10 are flow diagrams illustrating examples of preferred operation of the wear evaluation system. FIG. 7 shows that rod, tubing, and deviation data are first acquired with their respective sensors, during normal well work-over operations. The data is optionally displayed, compiled, correlated, and/or recorded in the field, such as with data acquisition computer system 14. Again, some of these steps may not be performed until data reaches server computer 16, to which the data is transmitted. The server computer 16 may record the data, further process the data, generate the optimal wellbore wear mitigation solution and act as a server as discussed previously.

Figure 8:
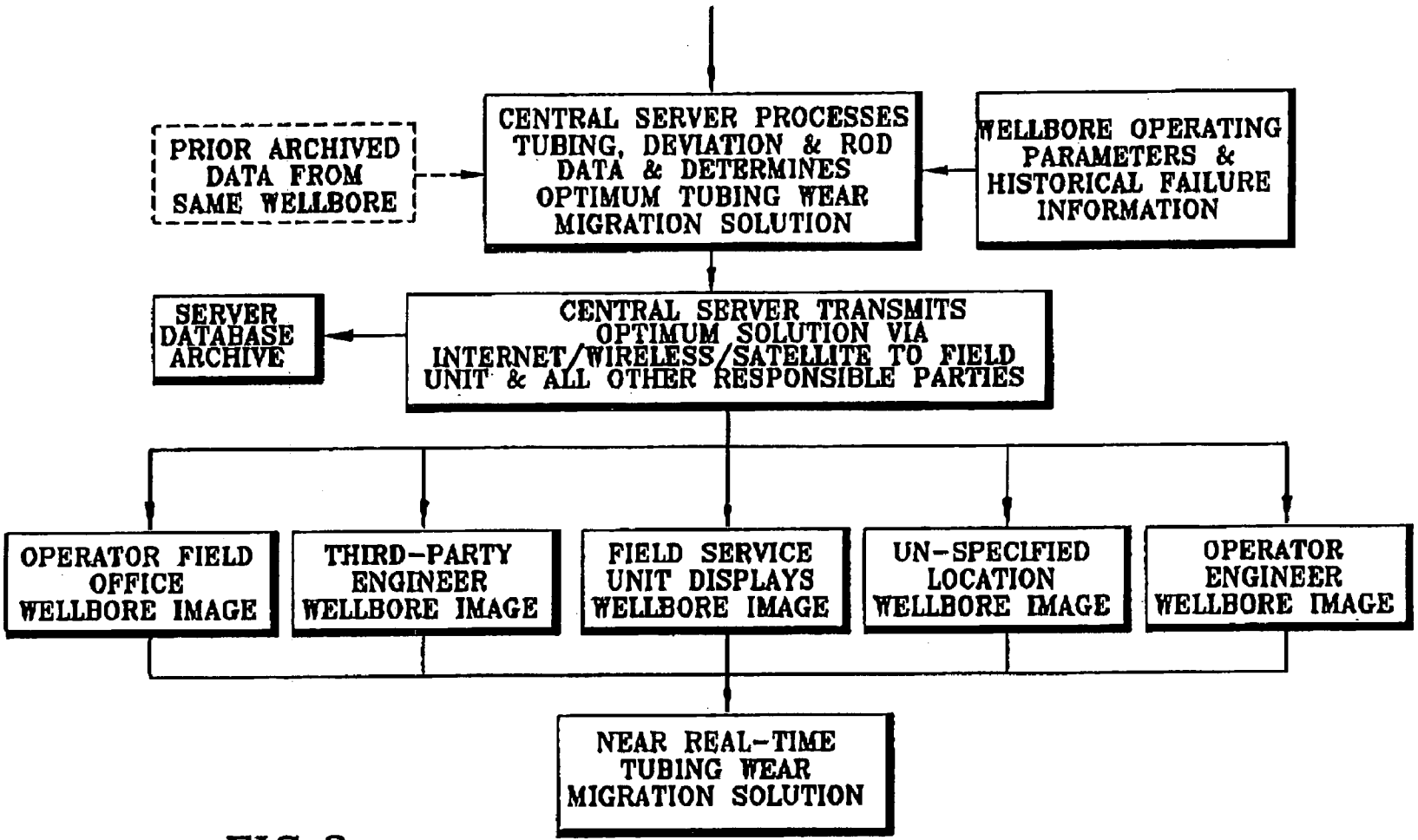

FIG. 8 illustrates that prior archived data from the same well, along with wellbore operating parameters and historical failure information, may be fed into the computer/server 26, which correlates the data and computes a wear mitigation solution. The server computer 16 then transmits the information back to the field, such as to data acquisition computer system 14, and to an archive database. The data may be made available to, displayed and interrogated by any authorized user of a computer with internet protocol access such as an operator field office, a third party engineer, a field server unit, another optional location to be specified, and an operator engineer, all at any location worldwide with authorization and internet access. This transmittal of raw data from the various sensors, through data acquisition computer system 14, to server computer 16, back to the data acquisition computer system 14 and any other location worldwide, via internet protocol, results in an internet published application of a real-time or nearly real-time wellbore wear mitigation solution.

Figure 9:
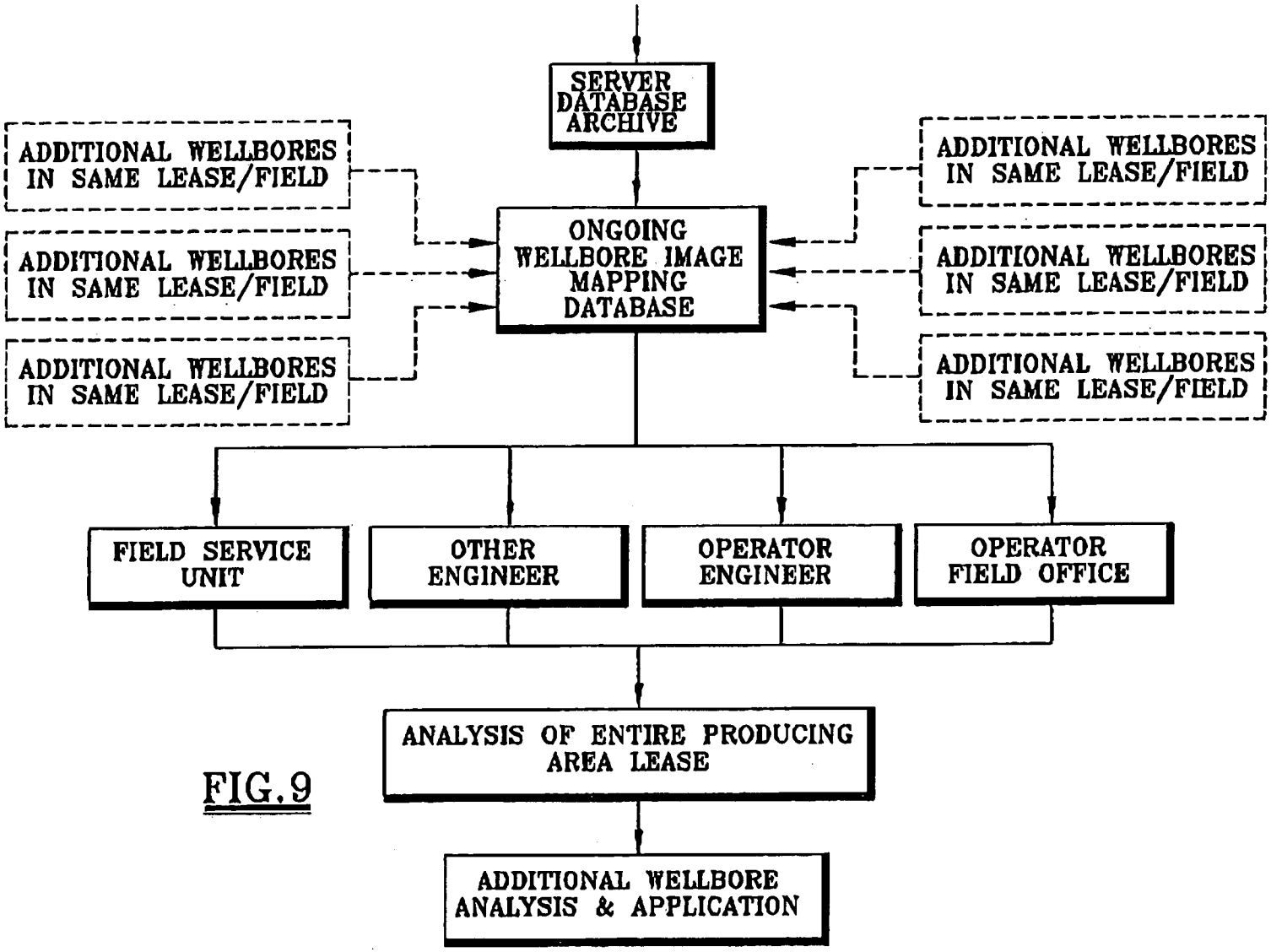

FIG. 9 illustrates how the wear evaluation system 10 may more broadly integrate raw and processed data to more comprehensively apply a wear mitigation solution. A variety of sources may feed the computer/server 26, such as the server database archive and simultaneous data from additional wellbores in the field and their corresponding wear evaluation sensors and systems. This culminates in an ongoing wellbore image mapping database, which may feed the field service unit, the operator engineer, other engineers, and the operator field office. The net result is a thorough analysis of the entire producing lease or field, including single wellbores in the lease or field, which may be simultaneously analyzed by multiple persons so as to provide a collaborative environment and thereafter continually analyzed and refined during the life of the lease and beyond. It is a benefit of the present invention that additional wellbores within the same lease may be evaluated by the system and also imaged within the isogram mapping capability of the system using internet protocol published application.

Figure 10:
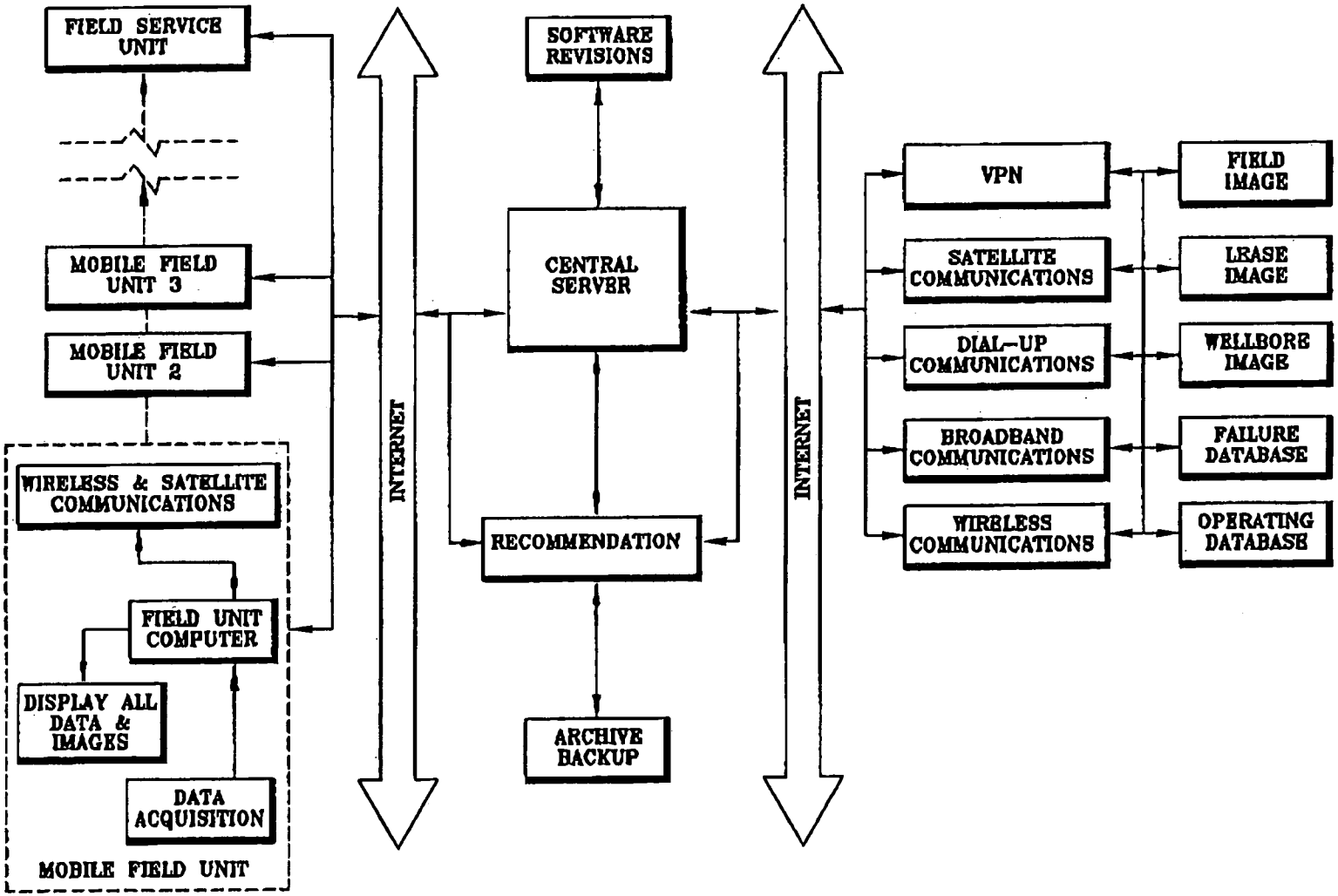

FIG. 10 is a diagram of a suitable system connected between a mobile field unit and a command location.

In one application, the deviation is retrieved with the normal workover process conducted to remove the tubing string from the well. The tool may be located in a landing nipple or seating sub at the lower end of the tubing string. The dropping speed of the tool may be retarded by utilizing one or more wire brushes that contact the inside surface of the tubing, or using scraper cups which also contact the inside surface of the tubing, or using parachute centralizers.

The tool may be retrieved from the bottom of the wellbore as the tubing is pulled to the surface by the workover rig. Tubing string lengths generally comprise two 30' sections between a breakout of the string. This results in a deviation or inclination tool standing stationary for a short period while the threaded connections are broken out. The tool may measure deviation of the wellbore both while in motion and while static.

FIG. 11 conceptually illustrates a 3-dimensional image of a producing area lease or field, including the surface location, depth, deviation, as to both inclination and azimuth, rod condition and tubing condition. FIG. 11 also shows a conceptual representation of a single wellbore image that has been "zoomed" into in order to analyze the specific deviation profile, rod profile and tubing profile at a specific depth. Other wellbores in the area with similar conditions may be correlated by color isograms mapping.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations, and modifications, including but not limited to those design alternatives specifically discussed herein, may be made in the practice of the invention without departing from its scope.

The invention claimed is:

1. A wellbore evaluation system for evaluating the condition of components of a well system, the well system including a production tubing string positionable in a well and a sucker rod string movable within the production tubing string, the system comprising:

two or more sensors selected from the group consisting of a deviation sensor movable within the well to sense and measure inclination of the wellbore to determine a deviation profile, a rod sensor for sensing and measuring wear or corrosion of the sucker rod string as it is removed from the well to determine a rod profile, and a tubing sensor for sensing and measuring wear or corrosion of the production tubing string as it is removed from the well to determine a tubing profile; and a computer in communication with the two or more sensors for computing and comparing two or more of the respective deviation profile, rod profile, and tubing profile as a function of depth in the well.

2. A system as defined in claim 1, wherein the computer compares all three of the deviation profile, rod profile, and tubing profile.

3. A system as defined in claim 2, wherein the computer determines and outputs a wear mitigation solution from one or more of the group, consisting of repositioning or installing rod guides with respect to specific depth zones of the sucker rod string, lining the production tubing string with a polymer lining at specific depths, rotating the production tubing string, rotating the sucker rod string, changing pump size, stroke or speed, changing the diameter of a section of the sucker rod string, and replacing one or more segments of the production tubing string or sucker rod string.

4. A system as defined in claim 1, wherein the computer outputs a visual representation of the comparison of two or more of the deviation profile, rod profile, and tubing profile.

5. A system as defined in claim 4, wherein the visual representation comprises a graphical display of two or more of the deviation profile, rod profile, and tubing profile.

6. A system as defined in claim 4, wherein the visual representation comprises a three dimensional plot of the deviation profile.

7. A system as defined in claim 1, wherein the computer compares two or more of the deviation profile, rod profile, and tubing profile with two or more of prior deviation, rod wear, and tubing wear data.

8. A system as defined in claim 1, wherein the computer compares one or more of the deviation profile, rod profile, and tubing profile from the well system with data from another well.

9. A system as defined in claim 1, further comprising:

a marking device for marking segments of one or both of the production tubing string and the sucker rod string when pulled from the well;

a tracking device responsive to the markings on the segments as they are inserted into the well; and a computer in communication with the tracking device for tracking the relative position of each of the segments of the respective production tubing string and sucker rod string.

10. A system as defined in claim 9, wherein the markings comprise bar code markings, and the tracking device comprises a bar code reader for reading the bar code markings.

11. A system as defined in claim 1, further comprising:

a wireless interface for interfacing the computer with the two or more sensors.

12. A system as defined in claim 11, wherein the computer is at a location spaced from the well and communicates with the well location using internet protocol by wireless, satellite or wired means.

13. A system as defined in claim 1, wherein the deviation sensor comprises:

three pairs of an accelerometer and a gyroscope, each pair being positioned orthogonally to each other.

14. A system as defined in claim 1, wherein the rod sensor comprises:

one or more of a magnetic flux sensor coil, Hall-effect device, an LVDT, and a laser micrometer.

15. A system as defined in claim 1, wherein the tubing sensor comprises:

one or more of a magnetic flux sensor coil and Hall-effect device.

16. A system as defined in claim 1, further comprising:

a plurality of differently sized sensor inserts for accommodating a plurality of diameters of the sucker rod string and production tubing, each sensor insert including the rod sensor or tubing sensor.

17. A system as defined in claim 16, further comprising:

a sensor barrel for selectively receiving each of the differently sized sensor inserts.

18. A system as defined in claim 1, wherein the rod sensor senses and measures one or more of wear to a coupling that joins segments of the sucker rod string, diameter of the coupling, wear to a rod guide, diameter of a rod guide, rod diameter, rod cross-sectional area, and pitting.

19. A system as defined in claim 1, wherein the tubing sensor senses and measures one or more of tubing wear, wall thickness, cross-sectional area and pitting.

20. A system as defined in claim 1, wherein the deviation sensor senses and measures one or more of wellbore dogleg severity, inclination angle, change in inclination angle along the well, and azimuth.

21. A method for evaluating wear to components of a well system, the well system including a production tubing string positionable in a well and a sucker rod string movable within the production tubing string, the method comprising:

selecting two or more sensors from the group consisting of a deviation sensor movable within the well to determine a deviation profile, a rod sensor for sensing wear to the sucker rod string as it is removed from the well to determine a rod profile, and a tubing sensor for sensing wear to the production tubing string as it is removed from the well to determine a tubing profile;

positioning two or more sensors at the wellhead; and computing and comparing two or more of the respective deviation profile, rod profile, and tubing profile.

22. A method as defined in claim 21, further comprising:

computing and comparing all three of the deviation sensor, rod sensor, and tubing sensor.

23. A method as defined in claim 21, further comprising:

determining a wear mitigation solution from one or more of the group consisting of repositioning or installing rod guides with respect to specific depth zones of the sucker rod string, lining the production tubing string with a polymer lining at specific depths, rotating the production tubing string, rotating the sucker rod string, changing pump size, stroke or speed, changing the diameter of a section of the sucker rod string, and replacing one or more segments of the production tubing string or sucker rod string.

24. A method as defined in claim 21, wherein comparing two or more of the deviation profile, rod profile, and tubing profile comprises:

outputting a visual representation of the correlation of two or more of the deviation profile, rod profile, and tubing profile.

25. A method as defined in claim 24, wherein outputting the visual representation comprises:

graphically displaying two or more of the deviation profile, rod profile, and tubing profile.

26. A method as defined in claim 24, wherein outputting the visual representation comprises:

plotting a three dimensional plot of the deviation.

27. A method as defined in claim 21, further comprising:

comparing two or more of the deviation profile, rod profile, and tubing profile with two or more of prior deviation, rod wear, and tubing wear data.

28. A method as defined in claim 21, further comprising:

comparing one or more of the deviation profile, rod profile, and tubing profile from the well system with data from another well.

29. A method as defined in claim 21, further comprising:

marking segments of one or both of the production tubing string and the sucker rod string with a unique identification when pulled from the well;

reading the markings on the segments as they are inserted into the well; and tracking the relative position of each of the segments of the respective production tubing string and sucker rod string.

30. A method as defined in claim 29, wherein marking segments comprises marking the segments with bar code, and reading the marked segments comprises reading the bar code with a bar code reader.

31. A method as defined in claim 21, further comprising:

wirelessly transmitting from the two or more sensors or from the computer at the well to a location spaced from the well.

32. A method as defined in claim 21, further comprising:

providing a plurality of differently sized sensor inserts for accommodating a plurality of diameters of the sucker rod string and production tubing, each sensor insert including the rod sensor or tubing sensor; and selecting one of the differently sized sensor inserts to accommodate a respective one of the plurality of diameters of the sucker rod string.

33. A method as defined in claim 21, wherein the rod sensor senses the presence of a coupling that joins segments of the sucker rod string and measures one or more of wear to the coupling, diameter of the coupling, wear to a rod guide, diameter of a rod guide, rod diameter, rod cross-sectional area, and pitting.

34. A method as defined in claim 21, wherein the tubing sensor senses and measures one or more of tubing wear, wall thickness, cross-sectional area and pitting.

35. A method as defined in claim 21, wherein the deviation sensor senses and measures one or more of wellbore dogleg severity, inclination angle, change in inclination angle along the well, and azimuth.

36. A method as defined in claim 21, wherein the deviation profile is obtained by locating a deviation sensor at a lower end of the production tubing string, and generating the deviation profile while the production tubing string is retrieved to the surface.

37. A method as defined in claim 36, wherein the deviation sensor is passed through the tubing string to land in the lower end of the production tubing string, and the speed of travel of the deviation sensor through the production tubing string is retarded by one or more wire brushes, scraper cups and parachute centralizers.

38. A rod wear evaluation system for evaluating wear to a segmented sucker rod string movable within a production tubing string, the segmented sucker rod string including a plurality of sucker rod segments coupled together with couplings, the rod wear evaluation system comprising:

a rod sensor for sensing wear to the sucker rod string as it is removed from the well to determine a rod profile, the rod sensor including one or more of a magnetic flux sensor coil, Hall-effect device, LVDT and a laser micrometer, each of the magnetic flux sensor and laser micrometer radially spaced from the couplings to remotely sense the wear to the sucker rod string; and a computer in communication with the rod sensor for computing the rod profile.

39. A rod wear evaluation system as defined in claim 38, further comprising:

a plurality of differently sized sensor inserts for accommodating a plurality of diameters of the segmented sucker rod string, each sensor insert including the rod sensor.

40. A rod wear evaluation system as defined in claim 38, further comprising:

a sensor barrel for selectively receiving each of the differently sized sensor inserts.

41. A rod wear evaluation system as defined in claim 39, wherein the rod sensor senses the presence of the couplings, and measures one or more of wear to the couplings, diameter of the couplings, wear to a rod guide, diameter of a rod guide, rod diameter, rod cross-sectional area, and pitting.

* * * * *